US012553438B1

(12) United States Patent
Rodriguez et al.

(10) Patent No.: US 12,553,438 B1
(45) Date of Patent: Feb. 17, 2026

(54) REAR HEAD WITH VORTEX OIL SEPARATOR FOR COMPRESSOR AND ELECTRIC COMPRESSOR WITH VORTEX OIL SEPARATOR

(71) Applicant: MAHLE INTERNATIONAL GMBH, Stuttgart (DE)

(72) Inventors: Abian Bautista Rodriguez, La Laguna (ES); David Ayza Parra, Banicassim (ES)

(73) Assignee: MAHLE INTERNATIONAL GMBH (DE)

( * ) Notice: Subject to any disclaimer, the term of this patent is extended or adjusted under 35 U.S.C. 154(b) by 0 days.

(21) Appl. No.: 19/037,428

(22) Filed: Jan. 27, 2025

(51) Int. Cl.
*F04C 29/02* (2006.01)
*F04C 18/02* (2006.01)

(52) U.S. Cl.
CPC ..... *F04C 29/026* (2013.01); *F04C 18/0215* (2013.01); *F04C 2240/30* (2013.01)

(58) Field of Classification Search
CPC . F04C 29/026; F04C 18/0215; F04C 2240/30
See application file for complete search history.

(56) References Cited

U.S. PATENT DOCUMENTS 7,736,137 B2 * 6/2010 Ueno ..... F04C 18/0215 418/55.6
11,867,173 B2 * 1/2024 Imai ..... F04C 28/28
12,320,354 B1 * 6/2025 Auken ..... F04C 18/0215
2017/0284397 A1 * 10/2017 Nagano ..... F04C 29/026
2020/0284259 A1 * 9/2020 Jang ..... B01D 45/16
2020/0332798 A1 * 10/2020 Park ..... F04C 29/02
2022/0410048 A1 12/2022 Kaburagi et al.
2023/0113193 A1 4/2023 Rinaldi et al.

FOREIGN PATENT DOCUMENTS

CN 111156168 A 5/2020
CN 218062674 U 12/2022
CN 218669816 U 3/2023
CN 218669817 U 3/2023
WO 2021015115 A1 1/2021
WO 2023096160 A1 6/2023

* cited by examiner

*Primary Examiner* — Jesse S Bogue
(74) *Attorney, Agent, or Firm* — Endurance Law Group PLC; James R. Yee

(57) ABSTRACT

An assembly associated with an electric scroll compressor is provided. The electric scroll compressor is configured to compress a refrigerant. The assembly may include a rear head, a refrigerant outlet port, and a vortex oil separator. The rear head at least partly defines a discharge volume. The discharge volume is configured to receive intermixed oil and pressurized refrigerant. The rear head includes a slot adjacent to, and in fluidic communication with, the discharge volume. The refrigerant outlet port is coupled to, and integral with, the rear head and in fluidic communication with the slot. The slot in the housing is configured to receive the vortex oil separator. The vortex oil separator is configured to receive the intermixed oil and refrigerant, to separate oil from the compressed refrigerant.

25 Claims, 11 Drawing Sheets

REAR HEAD WITH VORTEX OIL SEPARATOR FOR COMPRESSOR AND ELECTRIC COMPRESSOR WITH VORTEX OIL SEPARATOR

TECHNICAL FIELD

The present invention is related to electric compressors, and more particularly to electric compressors with vortex oil separator.

BACKGROUND OF THE INVENTION

Compressors have long been used in cooling systems. In particular, scroll-type compressors, in which an orbiting scroll is rotated in a circular motion relative to a fixed scroll to compress a refrigerant, have been used in systems designed to provide cooling in specific areas. For example, such scroll-type compressors have long been used in the HVAC systems of motor vehicles, such as automobiles, to provide air-conditioning. Such compressors may also be used, in reverse, in applications requiring a heat pump. Generally, these compressors are driven using rotary motion derived from the automobile's engine.

With the advent of battery-powered or electric vehicles and/or hybrid vehicles, in which the vehicle may be solely powered by a battery at times, such compressors must be driven or powered by the battery rather than an engine. Such compressors may be referred to as electric compressors.

In addition to cooling a passenger compart of the motor vehicle, electric compressors may be used to provide heating or cooling to other areas or components of the motor vehicle. For instance, it may be desired to heat or cool the electronic systems and the battery or battery compartment, when the battery is being charged, especially during fast charging modes, as such generate heat which may damage or degrade the battery and/or other system. It may also be used to cooling the battery during times when the battery is not being charged or used, as heat may damage or degrade the battery. Since the electric compressor may be run at various times, even when the motor vehicle is not in operation, such use, obviously, requires electrical energy from the battery, thus reducing the operating time of the battery. Additionally, electric compressors may run at a very high speed, e.g., 2,000 RPM (or higher). Such high speed may generate unwanted levels of noise.

Oil is used to provide lubrication between the moving components of the electric compressor. During operation, the oil and the refrigerant become mixed and it is necessary to separate some of the oil from the mixture of the oil and refrigerant before the refrigerant leaves the compressor. Some compressors use a vortex oil separator to separate the oil from the compressed refrigerant.

Compressed refrigerant generally exits the compressor from an outlet port. It is further becoming necessary to use different types of refrigerants that require narrower outlet ports. Current compressor vortex oil separators are totally or partially assembled through the outlet port. The separation efficiency (of separating the oil from the compressed refrigerant) may be partly dependent on a diameter associated with the vortex oil separator. With the vortex oil separator introduced within the outlet port, the overall diameter of the outlet port may be too narrow to be efficient.

A connecter coupled to the outlet port allows the outlet port to be coupled to an external system, thereby allowing compressed refrigerant to enter the external system. In the prior art, the use of a narrow outlet port (required with newer types of refrigerants, for example) or narrow connector (required by the external system, for example). prevents or makes more difficult assembly of an oil separator through or within the outlet port.

It is thus desirable, to provide an electric compressor having high efficiency, low-noise and maximum operating life. The present invention is aimed at one or more of the problems identified above.

BRIEF SUMMARY OF THE INVENTION

In a first aspect of the present invention, an assembly associated with an electric scroll compressor is provided. The electric scroll compressor is configured to compress a refrigerant. The assembly may include a rear head, a refrigerant outlet port, and a vortex oil separator. The rear head at least partly defining a discharge volume. The discharge volume is configured to receive intermixed oil and pressurized refrigerant. The rear head includes a slot adjacent to, and in fluidic communication with, the discharge volume. The refrigerant outlet port is coupled to, and integral with, the rear head and in fluidic communication with the slot. The refrigerant outlet port is configured to allow compressed refrigerant to exit the electric scroll compressor from the discharge volume. The slot in the rear head housing is configured to receive the vortex oil separator. The vortex oil separator is configured to receive the intermixed oil and refrigerant, to separate oil from the compressed refrigerant and to allow the compressed refrigerant to exit the discharge volume through the refrigerant outlet port.

In a second aspect of the present invention, a housing assembly associated with an electric scroll compressor is provided. The electric scroll compressor is configured to compress a refrigerant. The housing assembly includes a center housing, a rear head, a refrigerant outlet port, and a vortex oil separator. The rear head is coupled to the center housing. The center housing and the rear head define a discharge volume. The discharge volume is configured to receive intermixed oil and pressurized refrigerant. The rear head including a slot adjacent to, and in fluidic communication with, the discharge volume. The refrigerant outlet port is coupled to, and integral with, the rear head and in fluidic communication with the slot. The refrigerant outlet port is configured to allow compressed refrigerant to exit the electric scroll compressor from the discharge volume. The slot in the housing is configured to receive the vortex oil separator. The vortex oil separator is configured to receive the intermixed oil and refrigerant, to separate oil from the compressed refrigerant and to allow the compressed refrigerant to exit the electric scroll compressor through the refrigerant outlet port.

In a third aspect of the present invention, an electric scroll compressor configured to compress a refrigerant is provided. The electric scroll compressor includes a housing, a refrigerant inlet port, a refrigerant outlet port, a drive shaft, a compression device, and a vortex oil separator. The housing defines an intake volume and a discharge volume and includes a slot adjacent to, and in fluidic communication with the discharge volume. The refrigerant inlet port is coupled to the housing and is configured to introduce the refrigerant to the intake volume. The refrigerant outlet port is coupled to, and integral with, the housing and in fluidic communication with the slot. The refrigerant outlet port is configured to allow compressed refrigerant to exit the electric scroll compressor from the discharge volume. The drive shaft is rotatably coupled to the housing. The compression device is coupled to the drive shaft and has an orifice. The compression device is configured to receive the refrigerant from the intake volume and to compress the refrigerant as the drive shaft is rotated. The compression device is configured to release intermixed oil and compressed refrigerant through the orifice into the discharge volume. The slot in the housing is configured to receive the vortex oil separator. The vortex oil separator is configured to receive the intermixed oil and refrigerant, to separate oil from the compressed refrigerant, and to allow the compressed refrigerant to exit the electric scroll compressor through the refrigerant outlet port.

CLAUSES

1. An assembly associated with an electric scroll compressor, the electric scroll compressor configured to compress a refrigerant, comprising:

a rear head at least partly defining a discharge volume, the discharge volume configured to receive intermixed oil and pressurized refrigerant, the rear head including a slot adjacent to, and in fluidic communication with, the discharge volume;

a refrigerant outlet port coupled to, and integral with, the rear head and in fluidic communication with the slot, the refrigerant outlet port being configured to allow compressed refrigerant to exit the electric scroll compressor from the discharge volume; and, a vortex oil separator, the slot in the rear head being configured to receive the vortex oil separator via the discharge volume, wherein the vortex oil separator is configured to receive the intermixed oil and refrigerant, to separate oil from the compressed refrigerant and to allow the compressed refrigerant to exit the discharge volume through the refrigerant outlet port.

2. The assembly, as set forth in clause 1, wherein the rear head includes an integral oil return pathway, the integral oil pathway being in fluidic communication with the slot and configured to receive oil separated from the compressed refrigerant by the vortex oil separator.

3. The assembly, as set forth in clause 2, wherein the integral oil pathway is connected to an oil reservoir configured to receive the oil separated from the compressed refrigerant by the vortex oil separator.

4. The assembly, as set forth in clause 2, wherein the vortex oil separator includes:

a trough having an open end and a bottom surface, the open end being open to the discharge volume, the bottom surface having an aperture;

an interior cavity, the aperture in the bottom surface configured to allow the intermixed oil and compressed refrigerant to enter the interior cavity; and an outlet tube having a first end and a second end and being positioned within the interior cavity, the second end being adjacent the refrigerant outlet port, the first end of the outlet tube configured to receive compressed refrigerant separated from the oil.

5. The assembly, as set forth in clause 1, further including a retention mechanism configured to retain the vortex oil separator within the slot.

6. The assembly, as set forth in clause 5, wherein the retention mechanism includes a groove within the rear head configured to receive outer edge of the vortex oil separator.

7. The assembly, as set forth in clause 5, wherein the retention mechanism includes one or more fasteners configured to attach the vortex oil separator to the rear head.

8. A housing assembly associated with an electric scroll compressor, the electric scroll compressor configured to compress a refrigerant, comprising:

a center housing;

a rear head coupled to the center housing, the center housing and the rear head defining a discharge volume, the discharge volume configured to receive intermixed oil and pressurized refrigerant, the rear head including a slot adjacent to, and in fluidic communication with, the discharge volume;

a refrigerant outlet port coupled to, and integral with, the rear head and in fluidic communication with the slot, the refrigerant outlet port being configured to allow compressed refrigerant to exit the electric scroll compressor from the discharge volume; and, a vortex oil separator, the slot in the housing being configured to receive the vortex oil separator via the discharge volume, wherein the vortex oil separator is configured to receive the intermixed oil and refrigerant, to separate oil from the compressed refrigerant and to allow the compressed refrigerant to exit the electric scroll compressor through the refrigerant outlet.

9. The housing assembly, as set forth in clause 8, wherein the rear head includes an integral oil return pathway, the integral oil pathway being in fluidic communication with the slot and configured to receive oil separated from the compressed refrigerant by the vortex oil separator.

10. The housing assembly, as set forth in clause 9, wherein the center housing at least partly defines an oil reservoir connected to the integral oil pathway and being configured to receive the oil separated from the compressed refrigerant by the vortex oil separator.

11. The housing assembly, as set forth in clause 8, wherein the vortex oil separator includes:

a trough having an open end and a bottom surface, the open end being open to the discharge volume, the bottom surface having an aperture;

an interior cavity, the aperture in the bottom surface configured to allow the intermixed oil and compressed refrigerant to enter the interior cavity; and an outlet tube having a first end and a second end and being positioned within the interior cavity, the second end being adjacent the refrigerant outlet port, the first end of the outlet tube configured to receive compressed refrigerant separated from the oil.

12. The housing assembly, as set forth in clause 8, further including a retention mechanism configured to retain the vortex oil separator within the slot.

13. The housing assembly, as set forth in clause 12, wherein the retention mechanism includes a groove within the rear head for receiving outer edge of the vortex oil separator.

14. The housing assembly, as set forth in clause 12, wherein the retention mechanism includes one or more fasteners configured to attach the vortex oil separator to the rear head.

15. An electric scroll compressor configured to compress a refrigerant, comprising:

a housing defining an intake volume and a discharge volume, the housing including a slot adjacent to, and in fluidic communication with the discharge volume;

a refrigerant inlet port coupled to the housing and configured to introduce the refrigerant to the intake volume;

a refrigerant outlet port coupled to, and integral with, the housing and in fluidic communication with the slot, the refrigerant outlet port being configured to allow compressed refrigerant to exit the electric scroll compressor from the discharge volume;

a drive shaft rotatably coupled to the housing;

a compression device coupled to the drive shaft and having an orifice, the compression device configured to receive the refrigerant from the intake volume and to compress the refrigerant as the drive shaft is rotated, the compression device configured to release intermixed oil and compressed refrigerant through the orifice into the discharge volume; and, a vortex oil separator, the slot in the housing being configured to receive the vortex oil separator via the discharge volume, wherein the vortex oil separator is configured to receive the intermixed oil and refrigerant, to separate oil from the compressed refrigerant and to allow the compressed refrigerant to exit the electric scroll compressor through the refrigerant outlet.

16. The electric scroll compressor, as set forth in clause 15, further comprising a motor within the housing, the drive shaft being connected to the motor.

17. The electric scroll compressor, as set forth in clause 16, wherein the housing defines an inverter cavity, further including an inverter module within the inverter cavity and configured to convert direct current electrical power to alternating current electrical power.

18. The electric scroll compressor, as set forth in clause 17, wherein the compression device includes:

a fixed scroll located within, and being fixed relative to, the housing, and an orbiting scroll coupled to the drive shaft, the orbiting scroll and the fixed scroll forming a compression chamber for receiving the refrigerant from the intake volume and compressing the refrigerant as the drive shaft is rotated.

19. The electric scroll compressor, as set forth in clause 18, including a reed mechanism associated with the orifice to controllably release intermixed oil and compressed refrigerant from the compression chamber into the discharge chamber.

20. The electric scroll compressor, as set forth in clause 15, wherein the rear head includes an integral oil return pathway, the integral oil pathway being in fluidic communication with the slot and configured to receive oil separated from the compressed refrigerant by the vortex oil separator.

21. The electric scroll compress, set forth in clause 20, wherein the housing defines an oil reservoir connected to the integral oil pathway and being configured to receive the oil separated from the compressed refrigerant by the vortex oil separator.

22. The electric scroll compressor, as set forth in clause 21, wherein the vortex oil separator includes:

a trough having an open end and a bottom surface, the open end being open to the discharge volume, the bottom surface having an aperture;

an interior cavity, the aperture in the bottom surface configured to allow the intermixed oil and compressed refrigerant to enter the interior cavity; and an outlet tube having a first end and a second end and being positioned within the interior cavity, the second end being adjacent the refrigerant outlet port, the first end of the outlet tube configured to receive compressed refrigerant separated from the oil.

23. The electric scroll compressor, as set forth in clause 15, further including a retention mechanism configured to retain the vortex oil separator within the slot.

24. The electric scroll compressor, as set forth in clause 23, wherein the retention mechanism includes a groove within the rear head for receiving outer edge of the vortex oil separator.

25. The electric scroll compressor, as set forth in clause 23, wherein the retention mechanism includes one or more fasteners configured to attach the vortex oil separator to the housing.

BRIEF DESCRIPTION OF THE SEVERAL VIEWS OF THE DRAWINGS

These and other features and advantages of the present invention will become more readily appreciated when considered in connection with the following detailed description and appended drawings.

DETAILED DESCRIPTION OF THE INVENTION

With reference to the drawings, and in operation, the present invention is related to a vortex oil separator 50 associated with a housing assembly 52 of an electric compressor 10, for example, an electric scroll compressor. In the illustrated embodiment, the electric compressor 10 is intended to be operated in the orientation as shown in FIG. 1.

Figure 1:
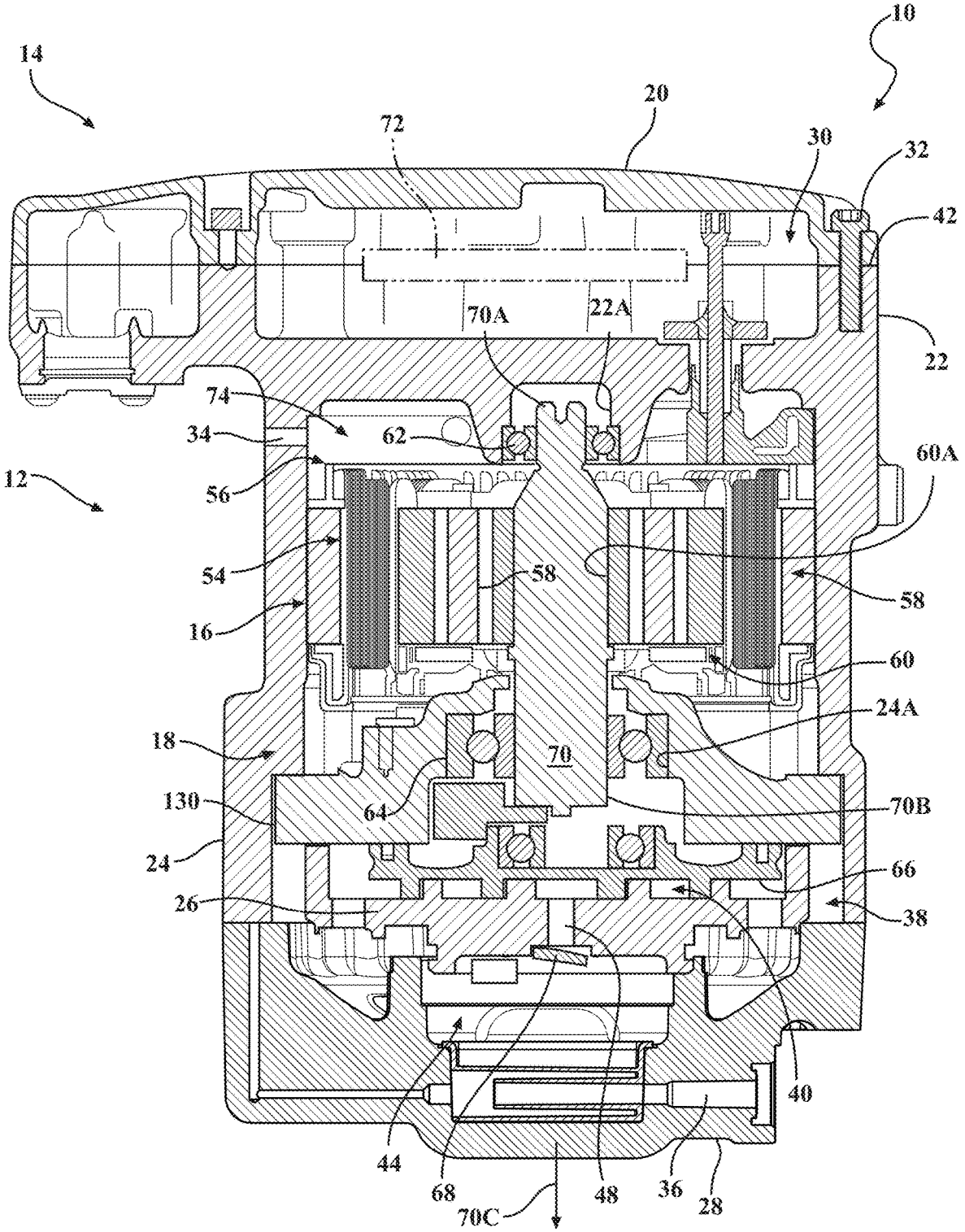
FIG. 1 is a cross-sectional view of an electric compressor according to an embodiment of the present invention.

With particular reference to FIG. 1, the electric compressor 10 has an outer housing 12 The electric compressor 10 may be particularly suitable in a motor vehicle, such as an automotive vehicle (not shown). The electric compressor 10 may be used as a cooling device or as a heating pump to heat and/or cool different aspects of the vehicle. For instance, the electric compressor 10 may be used as part of the heating, ventilation and air conditioning (HVAC) system in electric vehicles (not shown) to cool or heat a passenger compartment. In addition, the electric compressor 10 may be used to heat or cool the passenger compartment, on-board electronics and/or a battery used for powering the vehicle while the vehicle is not being operated, for instance, during a charging cycle. The electric compressor 10 may further be used while the vehicle is not being operated and while the battery is not being charged to maintain, or minimize the degradation, of the life of the battery.

In the illustrated embodiment, the electric compressor 10 is a scroll-type compressor acts to compress a refrigerant rapidly and efficiently for use in different systems of a motor vehicle, for example, an electric or a hybrid vehicle. With specific reference to FIG. 1, the electric compressor 10 includes an inverter section 14, a motor section 16, and a compression device (or compression assembly) 18 contained within the outer housing 12. The outer housing 12 includes an inverter back cover 20, an inverter housing 22 and a center housing 24 (which may be integral), a rear head 28 (which may be referred to as the discharge head). The center housing 24 houses the motor section 16 and the compression device 18.

In one embodiment, the inverter back cover 20, the electric compressor 22, the center housing 24, and the rear head 28 are composed from machined aluminum. The inverter 10 may be mounted, for example, within the body of a motor vehicle, via a plurality of mount points (not shown).

In the illustrated embodiment, the inverter back cover 20 and the inverter housing 22 form an inverter cavity 30. The inverter back cover 20 is mounted to the inverter housing 22 by a plurality of bolts 32. An inverter gasket 42, positioned between the inverter back cover 20 and the inverter housing 22 keeps moisture, dust, and other contaminants from the inverter cavity 30.

An inverter module 72 mounted within the inverter cavity 30 formed by the inverter back cover 20 and the inverter housing 22. The inverter module 72 may include an inverter circuit (not shown) mounted on a printed circuit board (not shown), which is mounted to the inverter housing 22. The inverter circuit converts direct current (DC) electrical power received from outside of the electric compressor 10 into three-phase alternating current (AC) power to supply/power a motor 54 (see below). The inverter circuit may also control the rotational speed of the electric compressor 10. High voltage DC current is supplied to the inverter circuit via a high voltage connector (not shown). Low voltage DC current to drive the inverter circuit, as well as control signals to control operation of the inverter circuit, and the motor section 16, may be supplied via a low voltage connecter (not shown).

Figure 12:
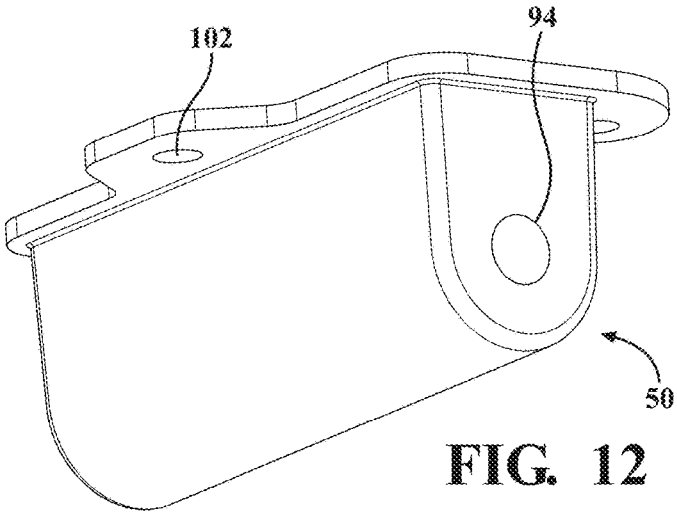
Figure 13:
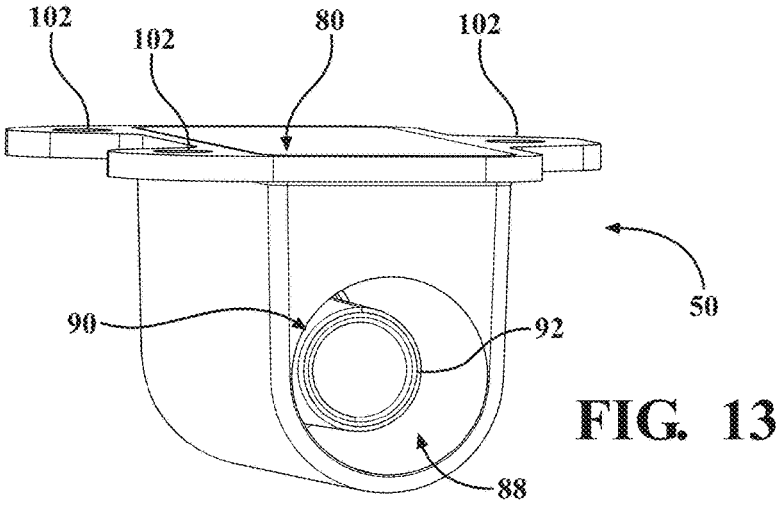

The center housing 24 forms a motor cavity 56. The motor section 16 includes a motor 54 located within the motor cavity 56. With specific reference to FIG. 12, in the illustrated embodiment, the motor 54 is a three-phase AC motor having a stator 58. The stator 58 has a generally hollow cylindrical shape with six individual coils (two for each phase). The stator 58 is contained within, and mounted to, the motor housing 22 and remains stationery relative to the motor housing 22.

The motor 54 includes a rotor 60 located within, and centered relative to, the stator 58. The rotor 60 has a generally hollow cylindrical shape and is located within the stator 56.

A drive shaft 70 is coupled to the rotor 60 and rotates therewith. In the illustrated embodiment, the draft shaft 70 is press-fit within a center aperture 60A of the rotor 60. The drive shaft 70 has a first end 70A and a second end 70B. The inverter housing 22 includes a first drive shaft supporting member 22A located on the motor side of the inverter housing 22. A first ball bearing 62 located within an aperture formed by the first drive shaft supporting member 22A supports and allows the first end of the drive shaft 70 to rotate. The center housing 24 includes a second drive shaft supporting member 24A. A second ball bearing 64 located within an aperture formed by the second drive shaft supporting member 24A allows the second end 70B of the drive shaft 70 to rotate. In the illustrated embodiment, the first and second ball bearing 62, 64 are press-fit with the apertures formed by the first drive shaft supporting member 22A of the inverter housing 22 and the second drive shaft supporting member 24A of the center housing 24, respectively.

As stated above, the electric compressor 10 is a scroll-type compressor. The compression device 18 includes the fixed scroll 26 and an orbiting scroll 66. The orbiting scroll 66 is fixed to the second end 70B of the drive shaft 70. The rotor 60 with the drive shaft 70 rotate to drive the orbiting scroll 66 motion under control of the inverter module 72.

The drive shaft 70 has a central axis 70C around which the rotor 60 and the drive shaft 70 are rotated. The orbiting scroll 66 moves about the central axis 70C in an eccentric orbit, i.e., in a circular motion while the orientation of the orbiting scroll 66 remains constant with respect to the fixed scroll 26. The center of the orbiting scroll 66 is located along an offset axis (not shown) of the drive shaft 70.

Figure 2:
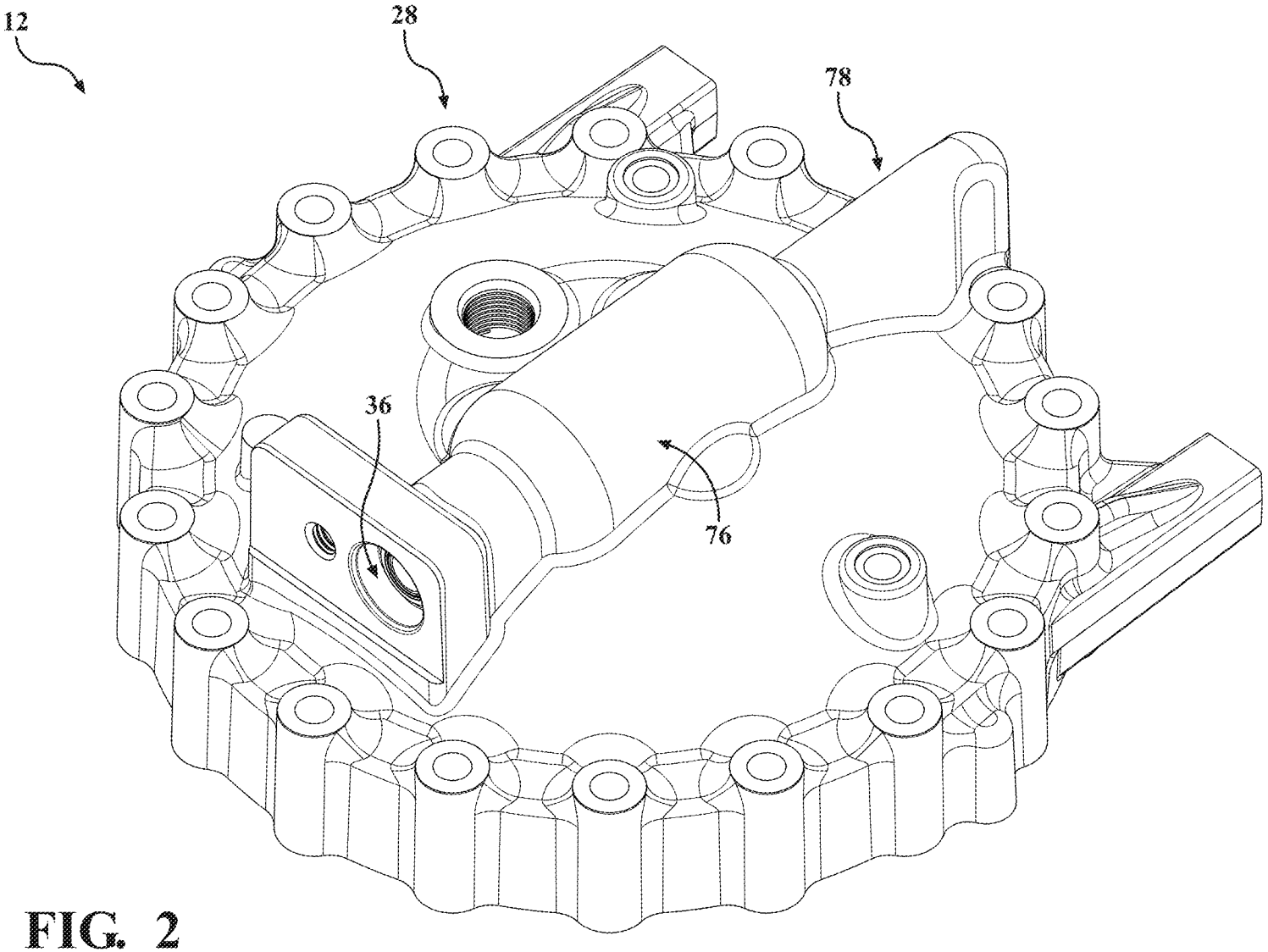
FIG. 2 is a perspective view of a rear head of the electric compressor or FIG. 1, according to an embodiment of the present invention.
Figure 3:
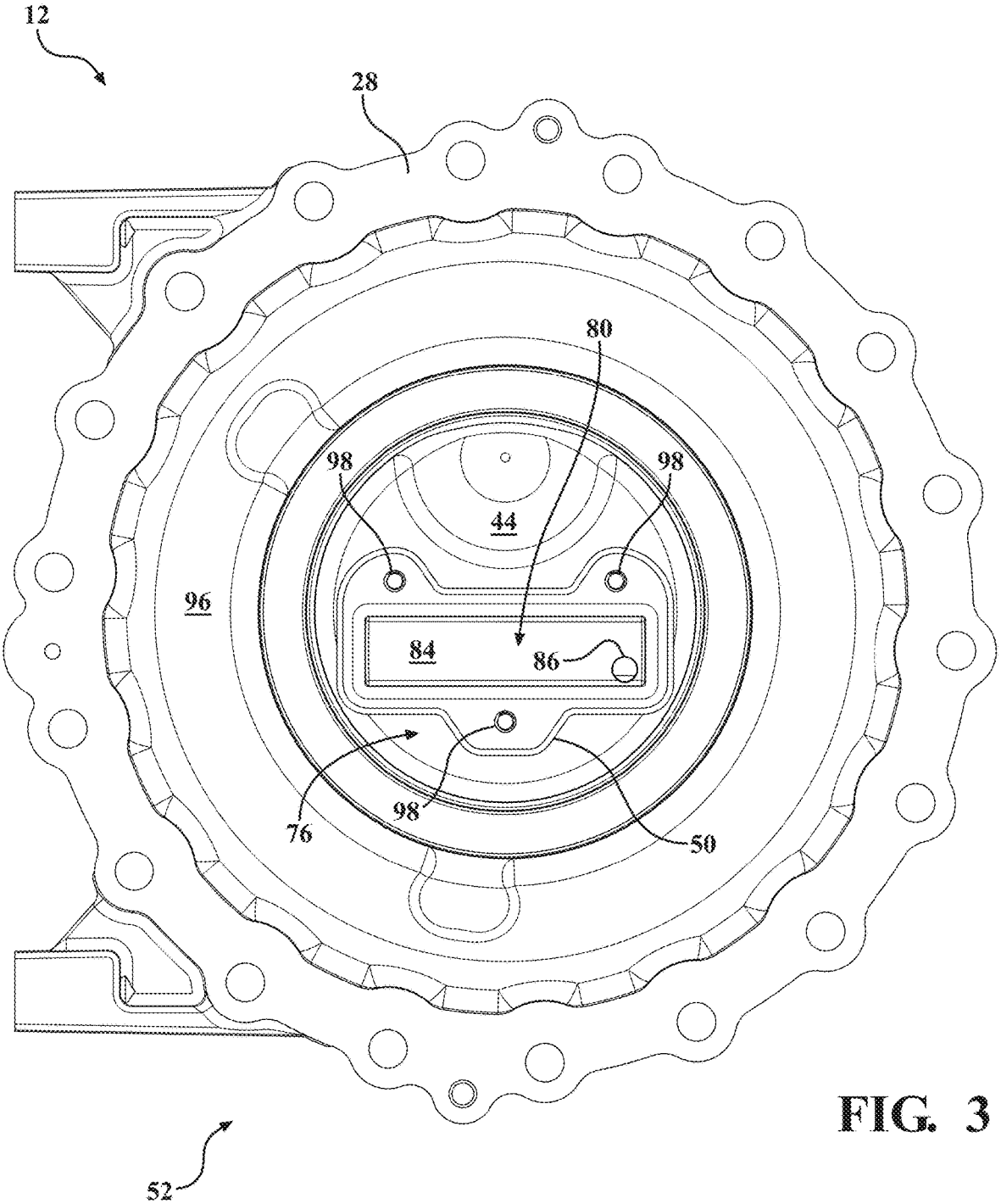
FIG. 3 is a front view of the rear head of FIG. 2 and a vortex oil separator, according to an embodiment of the present invention.
Figure 4:
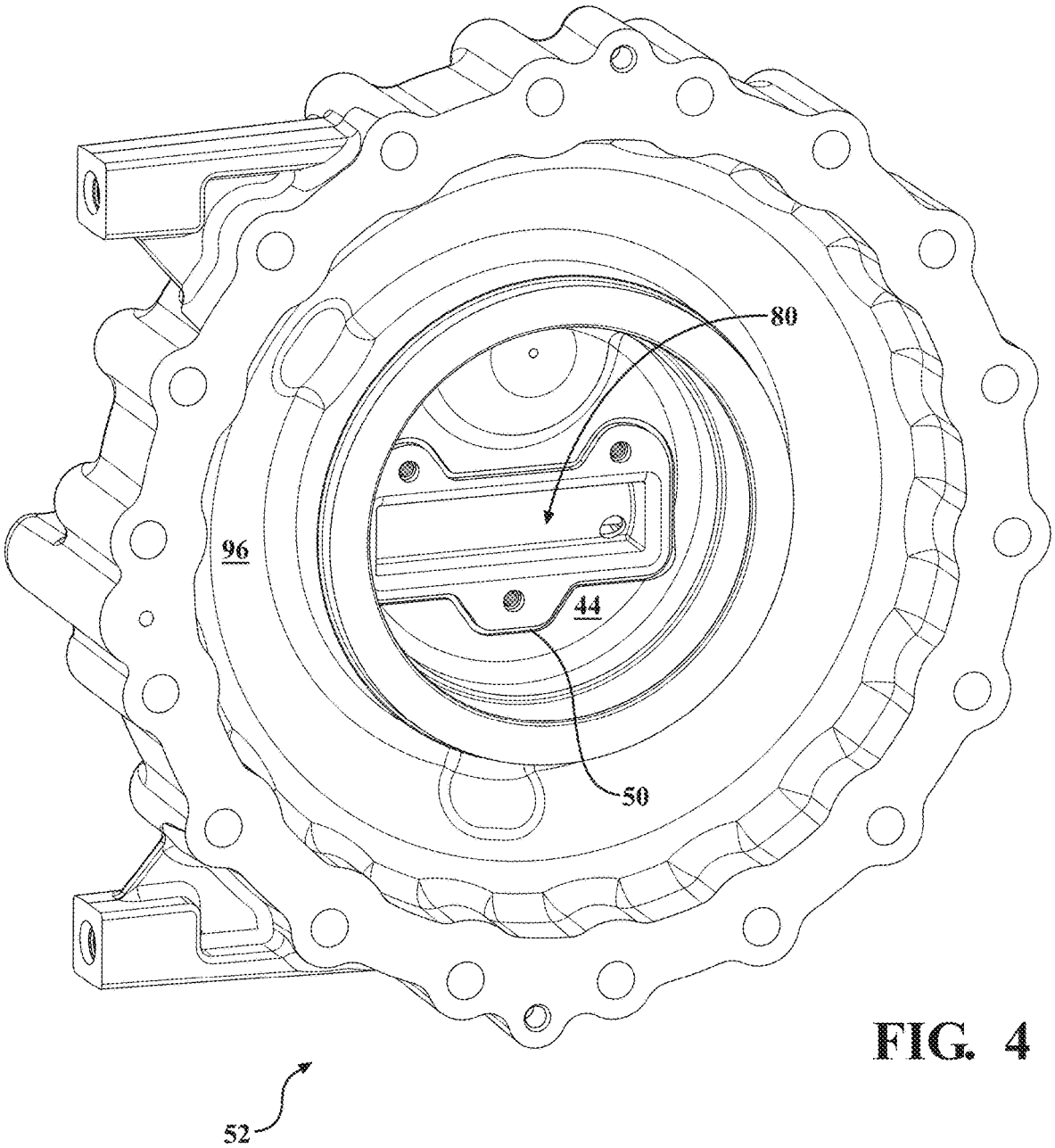
FIG. 4 is a perspective view of the rear head and vortex oil separator of FIG. 3.
Figure 5:
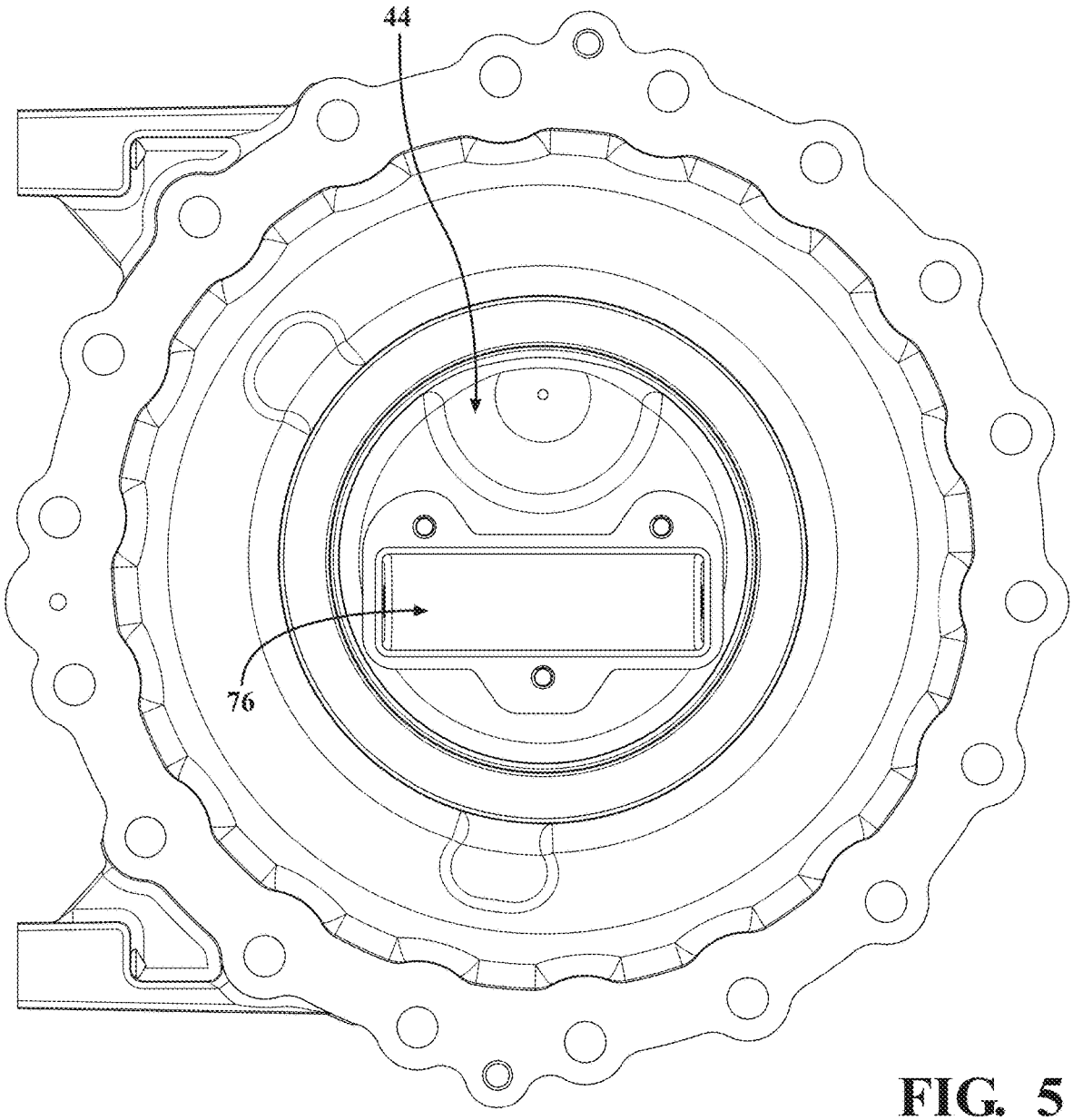
FIG. 5 is a front view of the rear head of FIG. 2.
Figure 6:
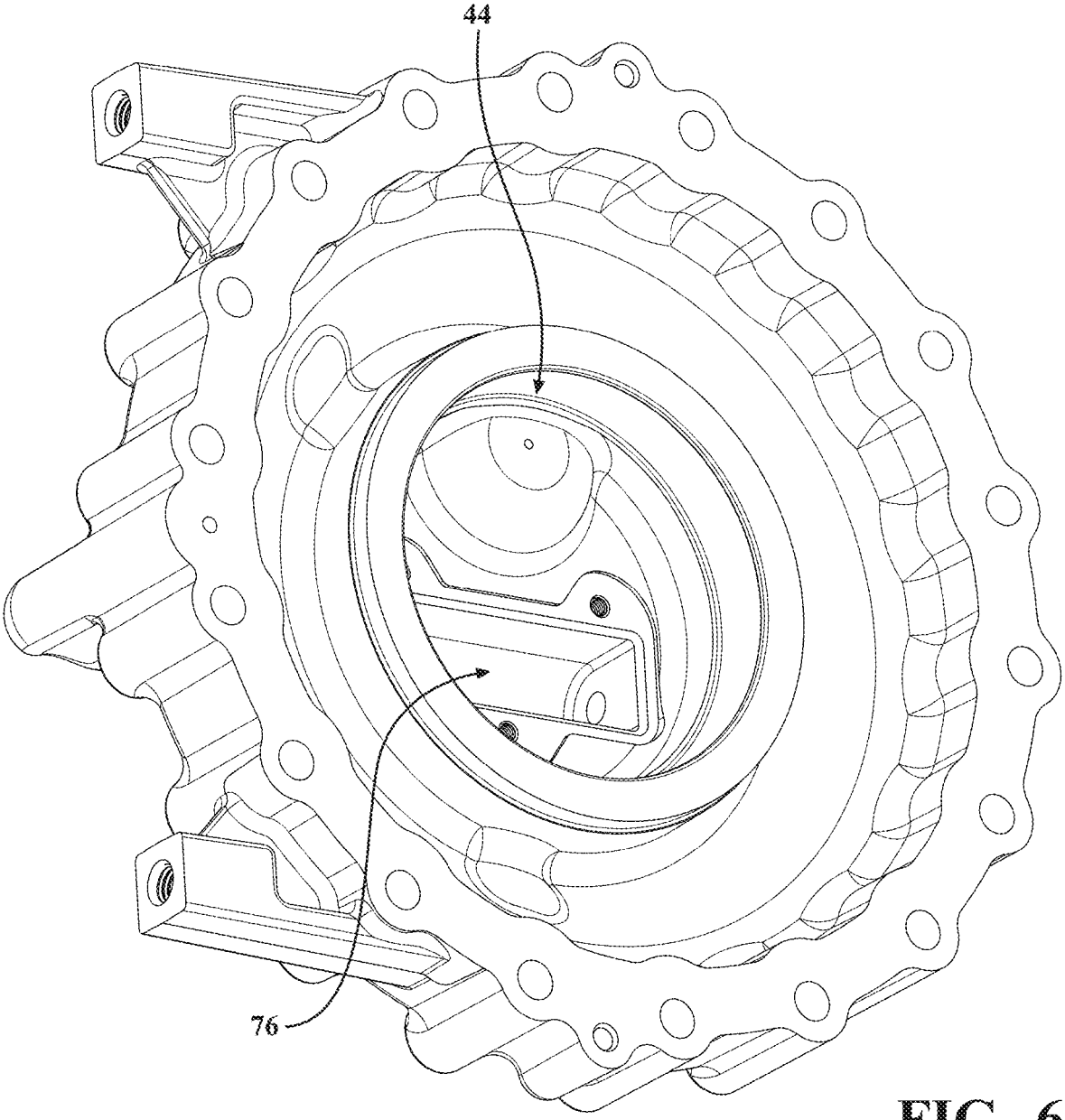
FIG. 6 is a perspective view of the rear head of FIG. 2.
Figure 7:
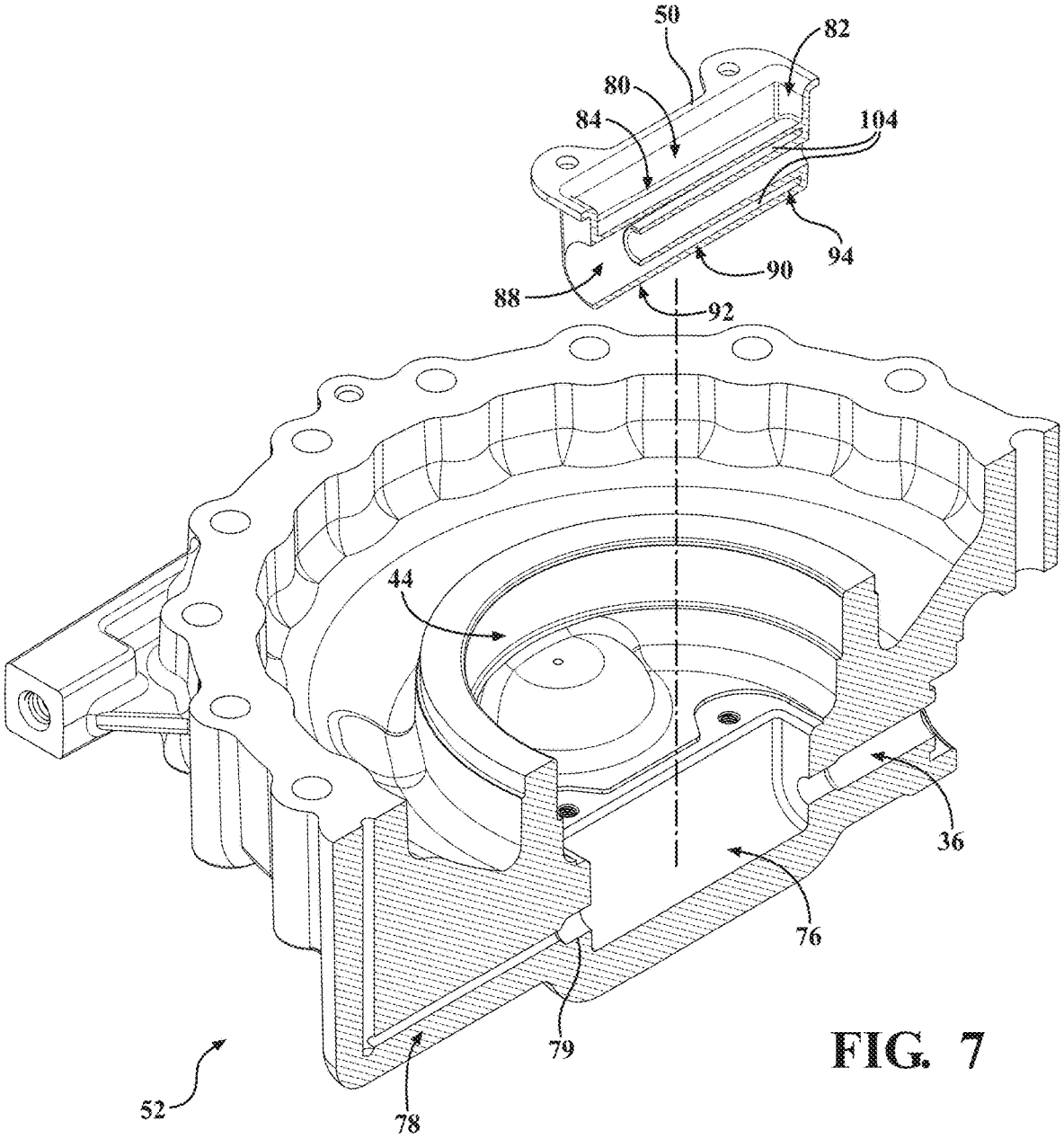
FIG. 7 is an exploded cross-sectional view of the rear head and vortex oil separator of FIG. 3.
Figure 8:
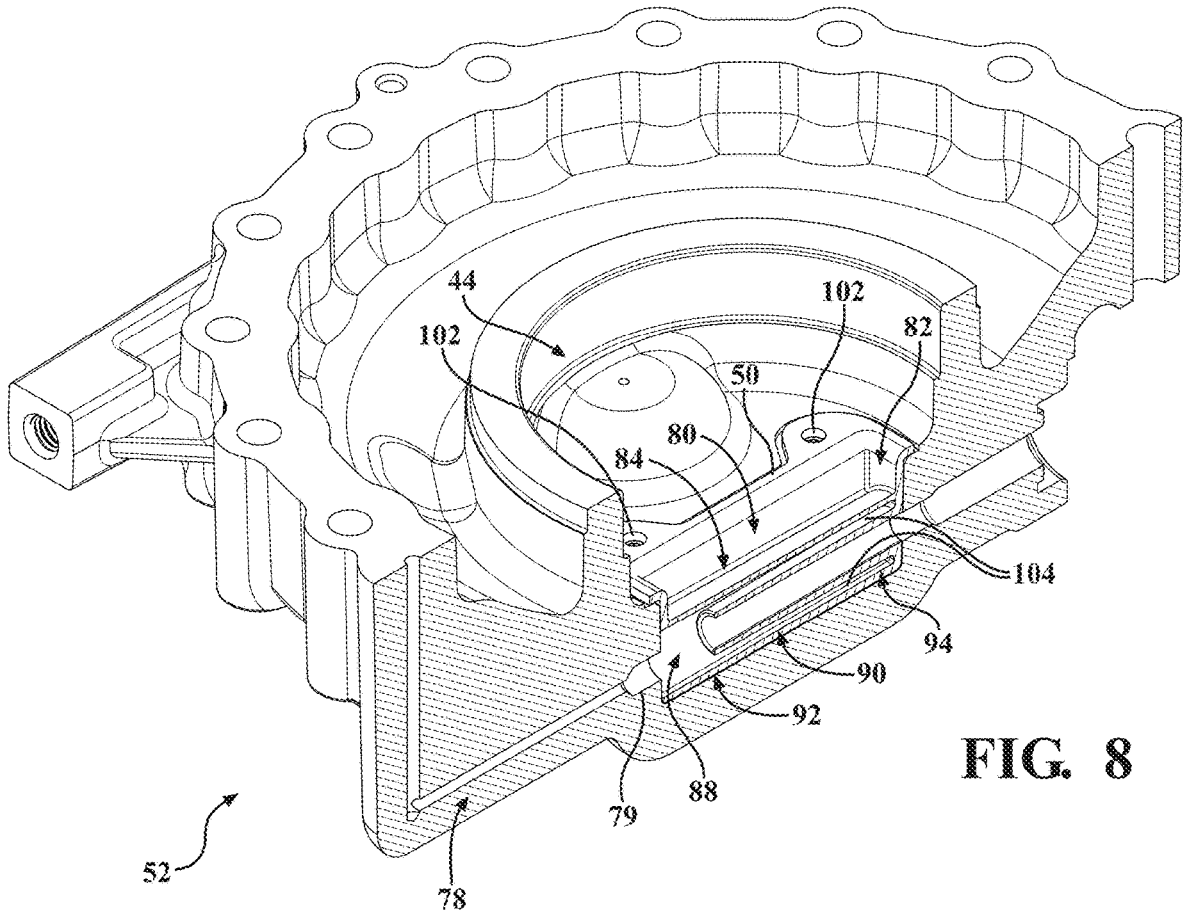
FIG. 8 is a cross-sectional view of the rear head and vortex oil separator of FIG. 3.
Figure 9:
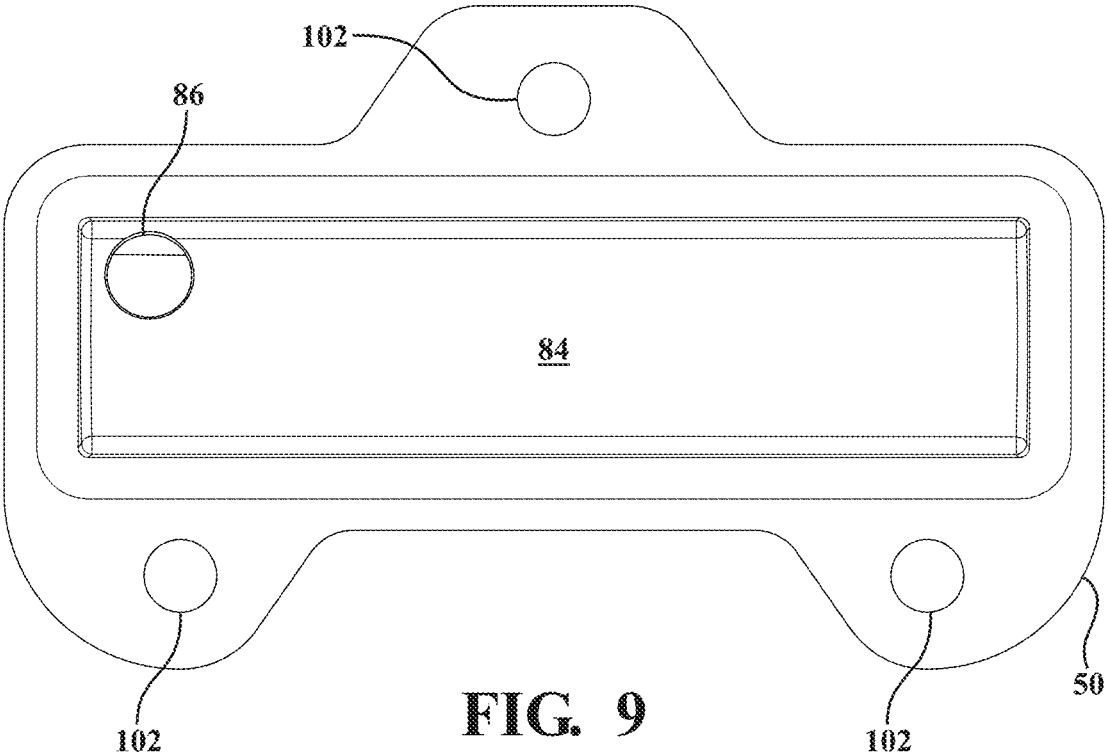
FIG. 9 is a top view of the vortex oil separator of FIG. 3.
Figure 10:
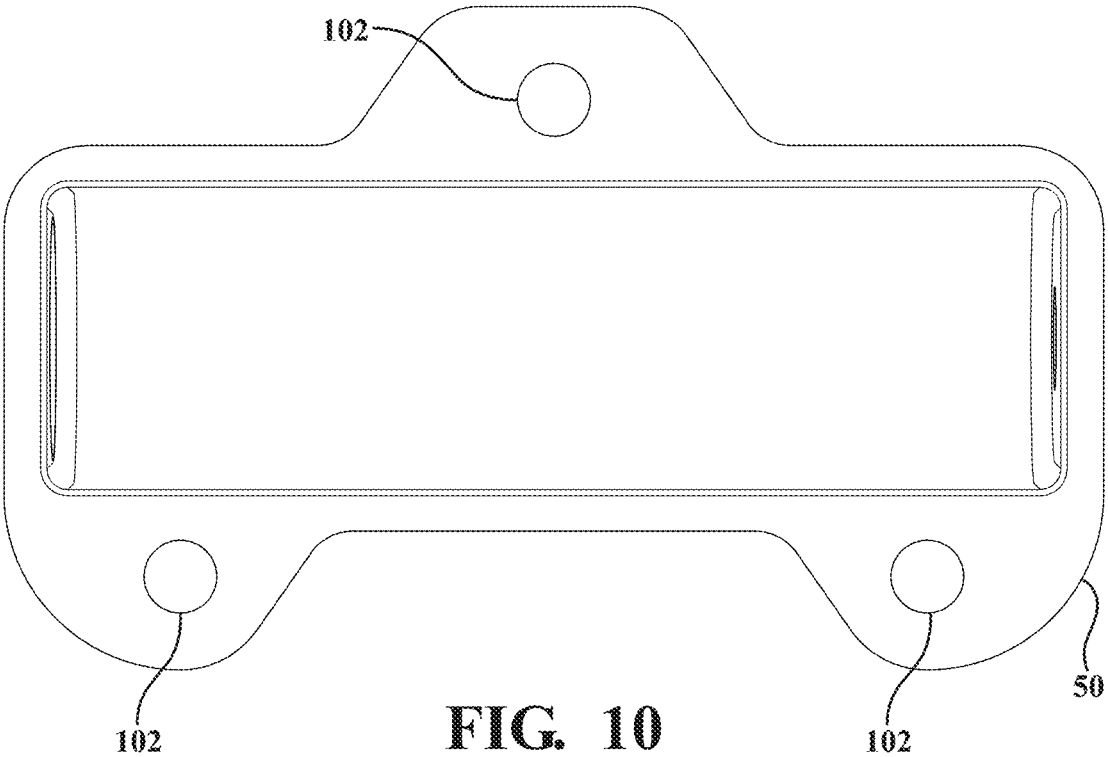
FIG. 10 is a top view of the vortex oil separator of FIG. 3.
Figure 11:
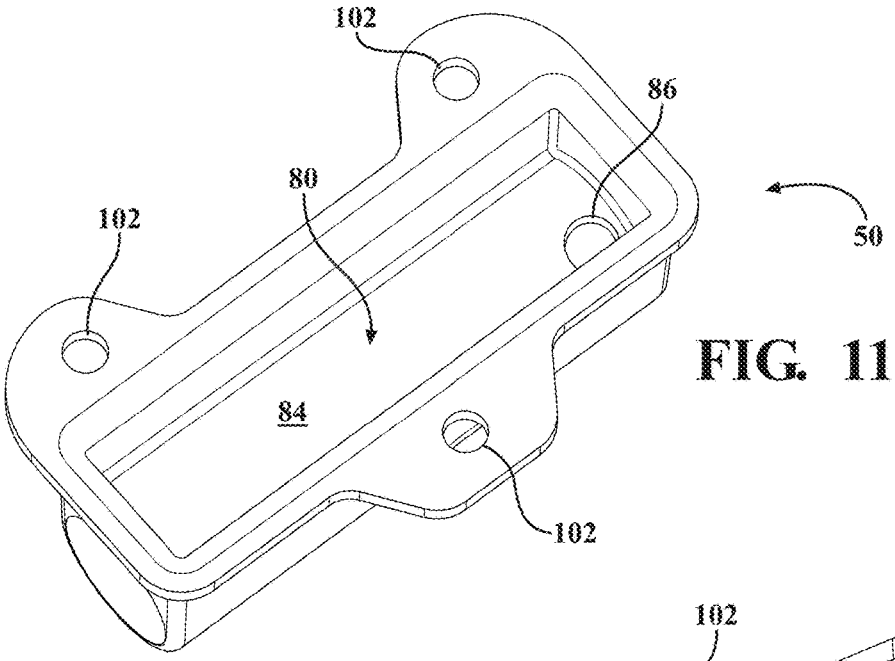
FIG. 11-13 are perspective views of the vortex oil separator of FIG. 3.

Generally, intermixed refrigerant and oil (at low pressure) enters the electric compressor 10 via a refrigerant inlet port 34 (see for example, FIG. 2A) and exits the electric compressor 10 (at high pressure) via refrigerant outlet port 36 after being compressed by the compression device 18. Refrigerant follows a refrigerant path through the electric compressor 10. Refrigerant enters the refrigerant inlet port and enters an intake volume 74 formed between the motor side of the inverter housing 22 and the center housing 24 adjacent the refrigerant inlet port. Refrigerant is then drawn through the motor section 16 and enters a compression intake volume formed between an internal wall of the fixed scroll 26 and the orbiting scroll 66.

The fixed scroll 26 is mounted within the center housing 24. Refrigerant enters the compression device 18 from the compression intake volume. The fixed scroll 26 and the orbiting scroll 66 form compression chambers 40 in which low or unpressurized (saturation pressure) refrigerant enters from the compression device 18. As the orbiting scroll 66 moves to enable the compression chambers 40 to be closed off and the volume of the compression chambers is reduced to pressurize the refrigerant. At any one time during the cycle, one or more compression chambers 40 are at different stages in the compression cycle. During a cycle of the compressor 10, the refrigerant is transported towards the center of the compression chambers 40.

Returning to FIG. 1, the rear head 28 forms a discharge volume 44. The discharge volume 44 is in communication with the refrigerant output port 36. Pressurized refrigerant leaves the compression device 18 through one or more orifices 48. The release of pressurized refrigerant is controlled by a reed mechanism 68.

With reference to FIGS. 2-13, the vortex oil separator 50 is positioned within, or adjacent to, the discharge volume 44. The vortex oil separator 50 and the housing 12, or in one embodiment, the rear head 28, form a housing assembly 52.

With particular reference to FIG. 1, the rear head 28, at least partly defines the discharge volume 44 As discussed above, the discharge volume 44 is configured to receive intermixed oil and pressurized refrigerant from the discharge chamber 40 in the compression device 18. As shown, in FIGS. 2, 7, and 8, the rear head 28 includes a slot 76 which is adjacent to, and in fluidic communication with, the discharge volume 44 and the refrigerant outlet port 36. The slot 76 is configured to receive the vortex oil separator 50.

The vortex oil separator 50 may be composed from a plastic material or a metal and may be formed via an injection molding process, a stamping process or other suitable process. The material or forming process may affect the shape or contour of different components of the vortex oil separator 50.

As shown, the slot 76 is positioned within the discharge volume 44, i.e., within the compressor 10 on the compressed) refrigerant side. The slot 76 is thus configured to receive the vortex oil separator 50 via the discharge volume 44. This allows the vortex oil separator 50 to be assembled or inserted into the compressor 10 via the inside of the compressor 10 rather than through the outlet port 36.

As shown, the refrigerant outlet port 36 is coupled to, and integral with, the rear head 28 and in fluidic communication with the slot 76 and the vortex oil separator 50. As discussed in more detail below, the vortex oil separator 50 receives intermixed oil and compressed refrigerant and separates the oil from the compressed refrigerant. The refrigerant outlet port 36 allows compressed refrigerant to exit the electric scroll compressor 10 from the discharge volume 44, and the electric compressor 10 through the refrigerant outlet port 36. The separated oil remains within the compressor 10 and is returned to moving parts of the compressor 10 for lubrication. The vortex oil separator 50 is configured to maximize the amount of oil retained within the compressor 10 to minimize or avoid release of oil from the compressor 10.

The rear head 28 may include an integral oil return pathway 78 in fluidic communication with the slot 76. The integral oil return pathway 78 may be fluidly coupled to an oil reservoir 38 formed by and within the housing 12. In the illustrated embodiment, the oil reservoir 38 may be formed at least in part by the center housing 24 and is configured to receive the oil separated from the compressed refrigerant by the vortex oil separator. The oil return pathway 78 may have a transition portion 79 to allow for the difference in diameter between the oil return pathway 78 and a corresponding aperture in the side of the vortex oil separator 50.

As shown, the vortex oil separator 50 may include a trough 80. The trough 80 may have an open end 82 and a bottom surface 84 (which may be curved, flat or some other shape). The open end 82 is adjacent to, and open to the discharge volume 44. Intermixed oil and compressed refrigerant enters the trough from the discharge volume 44 via the open end 82. The bottom surface 84 may include at least one aperture 86. As shown, the aperture 86 may be located adjacent or nearer to one side of the bottom surface 84.

Below the bottom surface 84 (in FIGS. 7 and 8), the vortex oil separator 50 includes an interior cavity 88 and an outlet tube 90 located within the interior cavity 88. As shown, the outlet tube 90 has a first end 92 and a second end 94. The second end 94 of the outlet tube 90 is adjacent, and open to, the refrigerant outlet port 36. The first end 92 of the outlet tube 90 is positioned within, and open to, the interior cavity 88 of the vortex oil separator 50.

In operation, intermixed oil and compressed refrigerant enters the interior cavity 88 of the vortex oil separator 50 via the aperture 86 and hits the curved outer surface of the outlet tube 90. The geometry of the vortex oil separator 50 results in the intermixed oil and compressed refrigerant being directed around outlet tube 90 in the direction of arrow 104 (see FIGS. 7 and 8). It should be noted that the vortex oil separator 50 could be configured to direct the intermixed oil and compressed refrigerant in the opposite direction. The intermixed oil and refrigerant hits the interior surface(s) of the interior cavity 88 and the outlet tube 90 and as a result of these forces and gravity, the oil separates from the compressed refrigerant. The separated oil and the compressed refrigerant exit the vortex oil separator 50 via the oil pathway 78 and the outlet port 36, respectively.

Since the vortex oil separator 50 is separate from the refrigerant outlet port 36, and, i.e., not within or part of the refrigerant outlet port 36, the vortex oil separator 50 does not impact the inner diameter of the refrigerant outlet port 36 and/or impede the flow of compressed refrigerant out of the compressor 10. In some embodiment, the inner diameter of the outlet tube 90 may be substantially the same as an inner diameter of the refrigerant outlet port 36. In other embodiments, the inner diameter of the outlet tube 90 may be smaller or larger than an inner diameter of the refrigerant outlet port 36.

Figure 14:
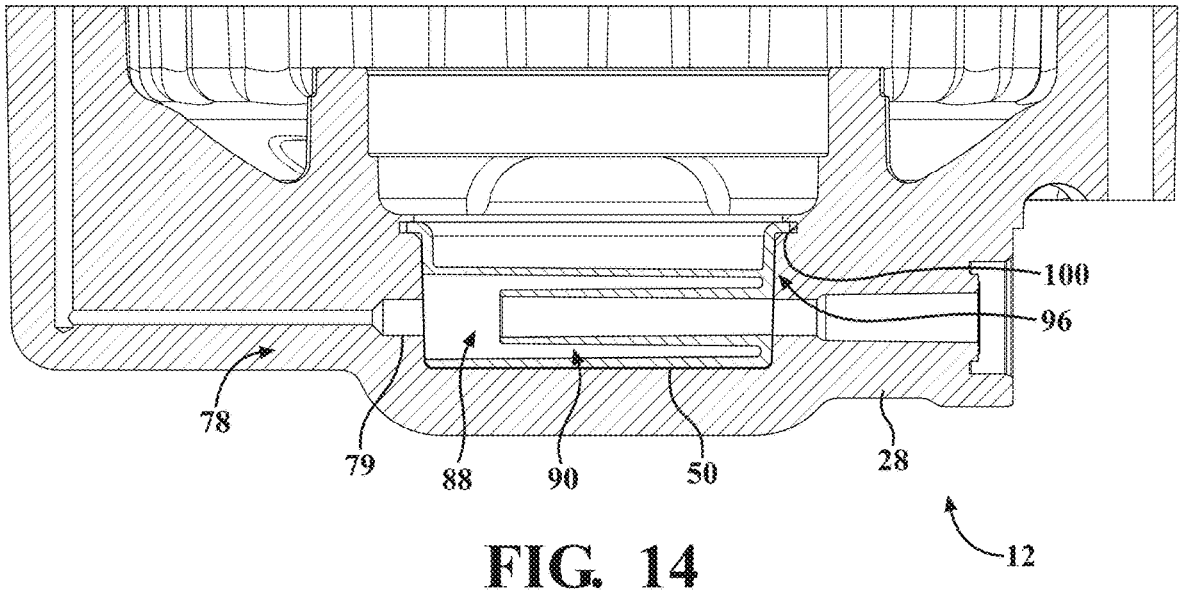
FIG. 14 is a perspective view of a rear head and vortex oil separator, according to an alternative embodiment of the present invention.

The assembly 52 may further include a retention mechanism 96 configured to retain the vortex oil separator 50 within the slot 76. In one embodiment, the retention mechanism 96 may includes a number of fasteners 98 and associated apertures 102 within the vortex oil separator 50 for affixing the vortex oil separator 50 to the rear head 26. In another embodiment, the retention mechanism 96 includes a groove 100 (see FIG. 14) within the rear head 28 for receiving outer edge of the vortex oil separator 50.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. An assembly associated with an electric scroll compressor, the electric scroll compressor configured to compress a refrigerant, comprising:

a rear head at least partly defining a discharge volume, the discharge volume configured to receive intermixed oil and pressurized refrigerant, the rear head including a slot adjacent to, and in fluidic communication with, the discharge volume;

a refrigerant outlet port coupled to, and integral with, the rear head and in fluidic communication with the slot, the refrigerant outlet port being configured to allow compressed refrigerant to exit the electric scroll compressor from the discharge volume; and, a vortex oil separator, the slot in the rear head being configured to receive the vortex oil separator via the discharge volume, wherein the vortex oil separator is configured to receive the intermixed oil and refrigerant, to separate oil from the compressed refrigerant and to allow the compressed refrigerant to exit the discharge volume through the refrigerant outlet port, wherein the vortex oil separator includes an aperture and is configured to receive the intermixed oil and refrigerant through the aperture.

2. The assembly, as set forth in claim 1, wherein the rear head includes an integral oil return pathway, the integral oil pathway being in fluidic communication with the slot and configured to receive oil separated from the compressed refrigerant by the vortex oil separator.

3. The assembly, as set forth in claim 2, wherein the integral oil pathway is connected to an oil reservoir configured to receive the oil separated from the compressed refrigerant by the vortex oil separator.

4. The assembly, as set forth in claim 2, wherein the vortex oil separator includes:

a trough having an open end and a bottom surface, the open end being open to the discharge volume, the bottom surface including the aperture;

an interior cavity, the aperture in the bottom surface configured to allow the intermixed oil and compressed refrigerant to enter the interior cavity; and an outlet tube having a first end and a second end and being positioned within the interior cavity, the second end being adjacent the refrigerant outlet port, the first end of the outlet tube configured to receive compressed refrigerant separated from the oil.

5. The assembly, as set forth in claim 1, further including a retention mechanism configured to retain the vortex oil separator within the slot.

6. The assembly, as set forth in claim 5, wherein the retention mechanism includes a groove within the rear head configured to receive outer edge of the vortex oil separator.

7. The assembly, as set forth in claim 5, wherein the retention mechanism includes one or more fasteners configured to attach the vortex oil separator to the rear head.

8. A housing assembly associated with an electric scroll compressor, the electric scroll compressor configured to compress a refrigerant, comprising:

a center housing;

a rear head coupled to the center housing, the center housing and the rear head defining a discharge volume, the discharge volume configured to receive intermixed oil and pressurized refrigerant, the rear head including a slot adjacent to, and in fluidic communication with, the discharge volume;

a refrigerant outlet port coupled to, and integral with, the rear head and in fluidic communication with the slot, the refrigerant outlet port being configured to allow compressed refrigerant to exit the electric scroll compressor from the discharge volume; and, a vortex oil separator, the slot in the housing being configured to receive the vortex oil separator via the discharge volume, wherein the vortex oil separator is configured to receive the intermixed oil and refrigerant, to separate oil from the compressed refrigerant and to allow the compressed refrigerant to exit the electric scroll compressor through the refrigerant outlet, wherein the vortex oil separator includes an aperture and is configured to receive the intermixed oil and refrigerant through the aperture.

9. The housing assembly, as set forth in claim 8, wherein the rear head includes an integral oil return pathway, the integral oil pathway being in fluidic communication with the slot and configured to receive oil separated from the compressed refrigerant by the vortex oil separator.

10. The housing assembly, as set forth in claim 9, wherein the center housing at least partly defines an oil reservoir connected to the integral oil pathway and being configured to receive the oil separated from the compressed refrigerant by the vortex oil separator.

11. The housing assembly, as set forth in claim 8, wherein the vortex oil separator includes:

a trough having an open end and a bottom surface, the open end being open to the discharge volume, the bottom surface including the aperture;

an interior cavity, the aperture in the bottom surface configured to allow the intermixed oil and compressed refrigerant to enter the interior cavity; and an outlet tube having a first end and a second end and being positioned within the interior cavity, the second end being adjacent the refrigerant outlet port, the first end of the outlet tube configured to receive compressed refrigerant separated from the oil.

12. The housing assembly, as set forth in claim 8, further including a retention mechanism configured to retain the vortex oil separator within the slot.

13. The housing assembly, as set forth in claim 12, wherein the retention mechanism includes a groove within the rear head for receiving outer edge of the vortex oil separator.

14. The housing assembly, as set forth in claim 12, wherein the retention mechanism includes one or more fasteners configured to attach the vortex oil separator to the rear head.

15. An electric scroll compressor configured to compress a refrigerant, comprising:

a housing defining an intake volume and a discharge volume, the housing including a slot adjacent to, and in fluidic communication with the discharge volume;

a refrigerant inlet port coupled to the housing and configured to introduce the refrigerant to the intake volume;

a refrigerant outlet port coupled to, and integral with, the housing and in fluidic communication with the slot, the refrigerant outlet port being configured to allow compressed refrigerant to exit the electric scroll compressor from the discharge volume;

a drive shaft rotatably coupled to the housing;

a compression device coupled to the drive shaft and having an orifice, the compression device configured to receive the refrigerant from the intake volume and to compress the refrigerant as the drive shaft is rotated, the compression device configured to release intermixed oil and compressed refrigerant through the orifice into the discharge volume; and, a vortex oil separator, the slot in the housing being configured to receive the vortex oil separator via the discharge volume, wherein the vortex oil separator is configured to receive the intermixed oil and refrigerant, to separate oil from the compressed refrigerant and to allow the compressed refrigerant to exit the electric scroll compressor through the refrigerant outlet, wherein the vortex oil separator includes an aperture and is configured to receive the intermixed oil and refrigerant through the aperture.

16. The electric scroll compressor, as set forth in claim 15, further comprising a motor within the housing, the drive shaft being connected to the motor.

17. The electric scroll compressor, as set forth in claim 16, wherein the housing defines an inverter cavity, further including an inverter module within the inverter cavity and configured to convert direct current electrical power to alternating current electrical power.

18. The electric scroll compressor, as set forth in claim 17, wherein the compression device includes:

a fixed scroll located within, and being fixed relative to, the housing, and an orbiting scroll coupled to the drive shaft, the orbiting scroll and the fixed scroll forming a compression chamber for receiving the refrigerant from the intake volume and compressing the refrigerant as the drive shaft is rotated.

19. The electric scroll compressor, as set forth in claim 18, including a reed mechanism associated with the orifice to controllably release intermixed oil and compressed refrigerant from the compression chamber into the discharge chamber.

20. The electric scroll compressor, as set forth in claim 15, wherein the rear head includes an integral oil return pathway, the integral oil pathway being in fluidic communication with the slot and configured to receive oil separated from the compressed refrigerant by the vortex oil separator.

21. The electric scroll compress, set forth in claim 20, wherein the housing defines an oil reservoir connected to the integral oil pathway and being configured to receive the oil separated from the compressed refrigerant by the vortex oil separator.

22. The electric scroll compressor, as set forth in claim 21, wherein the vortex oil separator includes:

a trough having an open end and a bottom surface, the open end being open to the discharge volume, the bottom surface including the aperture;

an interior cavity, the aperture in the bottom surface configured to allow the intermixed oil and compressed refrigerant to enter the interior cavity; and an outlet tube having a first end and a second end and being positioned within the interior cavity, the second end being adjacent the refrigerant outlet port, the first end of the outlet tube configured to receive compressed refrigerant separated from the oil.

23. The electric scroll compressor, as set forth in claim 15, further including a retention mechanism configured to retain the vortex oil separator within the slot.

24. The electric scroll compressor, as set forth in claim 23, wherein the retention mechanism includes a groove within the rear head for receiving outer edge of the vortex oil separator.

25. The electric scroll compressor, as set forth in claim 23, wherein the retention mechanism includes one or more fasteners configured to attach the vortex oil separator to the housing.

* * * * *